US012723472B1

(12) United States Patent
Raisanen et al.

(10) Patent No.: US 12,723,472 B1
(45) Date of Patent: Sep. 1, 2026

(54) VARIABLE CUTTING ELEMENT EXPOSURE IN A CUTTING TOOL

(71) Applicant: Schlumberger Technology Corporation, Sugar Land, TX (US)

(72) Inventors: Craig Raisanen, Houston, TX (US); Mason Cherry, Houston, TX (US); Philip Trunk, Houston, TX (US); Scott D. McDonough, Woodlands, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/346,015

(22) Filed: Sep. 30, 2025

(51) Int. Cl.
*E21B 10/14* (2006.01)
*E21B 10/43* (2006.01)

(52) U.S. Cl.
CPC ..... *E21B 10/14* (2013.01); *E21B 10/43* (2013.01)

(58) Field of Classification Search
CPC ..... E21B 10/14; E21B 10/43
See application file for complete search history.

(56) References Cited

U.S. PATENT DOCUMENTS

2009/0126998 A1* 5/2009 Zahradnik ..... E21B 10/43 175/57
2010/0025119 A1* 2/2010 Stauffer ..... E21B 10/14 175/341
2010/0155145 A1* 6/2010 Pessier ..... E21B 10/43 175/336
2010/0320001 A1* 12/2010 Kulkarni ..... E21B 10/14 175/336
2011/0079444 A1* 4/2011 Kulkarni ..... E21B 10/22 175/428
2016/0108680 A1* 4/2016 Rothe ..... E21B 10/60 175/57
2019/0136633 A1* 5/2019 Schoen ..... E21B 10/42

* cited by examiner

*Primary Examiner* — David Carroll
(74) *Attorney, Agent, or Firm* — Jeffrey D. Frantz

(57) ABSTRACT

A drill bit may include a bit body having a bit axis about which the bit body is configured to rotate in a rotational direction. A drill bit may include a roller cone connected to the bit body and having a cone axis around which the roller cone is configured to rotate, the roller cone having a plurality of cutting inserts positioned in a surface of the roller cone, wherein the plurality of cutting inserts form a rolling cutting profile when rotated in around the cone axis. A drill bit may include a blade having a plurality of fixed cutting elements coupled thereto, wherein the plurality of fixed cutting elements define a fixed cutting profile, wherein the rolling cutting profile has an exposure above the fixed cutting profile and the exposure increases in a bit radial direction away from the bit axis.

20 Claims, 7 Drawing Sheets

VARIABLE CUTTING ELEMENT EXPOSURE IN A CUTTING TOOL

BACKGROUND OF THE DISCLOSURE

The majority of footage drilled in an earth formation uses a plurality of fixed cutting elements to scrape and fracture rock and other material in the downhole environment. The torque experienced by the cutting elements of the drill bit varies with the radial position of the cutting element as well as the depth of cut and strength of the formation.

SUMMARY

In some aspects, the techniques described herein relate to a drill bit including: a bit body having a bit axis about which the bit body is configured to rotate in a rotational direction; a roller cone connected to the bit body and having a cone axis around which the roller cone is configured to rotate, the roller cone having a plurality of cutting inserts positioned in a surface of the roller cone, wherein the plurality of cutting inserts form a rolling cutting profile when rotated in around the cone axis; and a blade having a plurality of fixed cutting elements coupled thereto, wherein the plurality of fixed cutting elements define a fixed cutting profile, wherein the rolling cutting profile superimposes on the fixed cutting profile in the rotational direction of the bit body and the rolling cutting profile has an exposure above the fixed cutting profile in at least a nose region of the fixed cutting profile to a shoulder region of the fixed cutting profile and the exposure increases in a bit radial direction away from the bit axis.

In some aspects, the techniques described herein relate to a drill bit including: a bit body having a bit axis about which the bit body is configured to rotate in a rotational direction; a roller cone connected to the bit body and having a cone axis around which the roller cone is configured to rotate, the roller cone having a plurality of cutting inserts positioned in a surface of the roller cone, wherein the plurality of cutting inserts form a rolling cutting profile when rotated in around the cone axis; and a blade having a plurality of fixed cutting elements coupled thereto, wherein the plurality of fixed cutting elements define a fixed cutting profile, wherein the rolling cutting profile superimposes on the fixed cutting profile in the rotational direction of the bit body and the rolling cutting profile has an exposure above the fixed cutting profile in at least a nose region of the fixed cutting profile to a shoulder region of the fixed cutting profile and the exposure is at least partially based on an angular distance between a rotationally aligned pair of a cutting insert of the rolling cutting profile and a fixed cutting element of the fixed cutting profile.

In some aspects, the techniques described herein relate to a drill bit including: a bit body having a bit axis about which the bit body is configured to rotate in a rotational direction; a roller cone connected to the bit body and having a cone axis around which the roller cone is configured to rotate, the roller cone having a plurality of cutting inserts positioned in a surface of the roller cone, wherein the plurality of cutting inserts form a rolling cutting profile when rotated in around the cone axis; a primary blade having a plurality of primary fixed cutting elements coupled thereto, wherein the plurality of primary fixed cutting elements define a primary fixed cutting profile; and a secondary blade having a plurality of secondary fixed cutting elements coupled thereto, wherein the plurality of secondary fixed cutting elements define a secondary fixed cutting profile, wherein the rolling cutting profile superimposes on the primary fixed cutting profile and the secondary fixed cutting profile in the rotational direction of the bit body and the rolling cutting profile has a primary exposure above the primary fixed cutting profile and a secondary exposure above the secondary fixed cutting profile in at least a nose region to a shoulder region, and wherein the primary exposure is based at least partially on: a primary radial distance between a rotationally aligned primary pair of a cutting insert of the rolling cutting profile and a fixed cutting element of the primary fixed cutting profile, and a primary angular distance between the primary pair, and wherein the secondary exposure is based at least partially on: a secondary radial distance between a rotationally aligned secondary pair of a cutting insert of the rolling cutting profile and a fixed cutting element of the secondary fixed cutting profile, and a secondary angular distance between the secondary pair.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 3-1 is a bottom view of another hybrid drill bit, according to at least some embodiments of the present disclosure.

FIG. 3-2 is a schematic representation of a first pair of cutting elements of the hybrid drill bit of FIG. 3-1 removing formation material, according to at least some embodiments of the present disclosure.

FIG. 3-3 is a schematic representation of a second pair of cutting elements of the hybrid drill bit of FIG. 3-1 removing formation material, according to at least some embodiments of the present disclosure.

FIG. 4-1 is a bit cutting profile of a hybrid drill bit rotated into a single plane, according to at least some embodiments of the present disclosure.

FIG. 4-2 is a schematic representation of fixed cutting element at the radially-outward end of the nose region of FIG. 4-1 removing formation material, according to at least some embodiments of the present disclosure.

DETAILED DESCRIPTION

Figure 1:
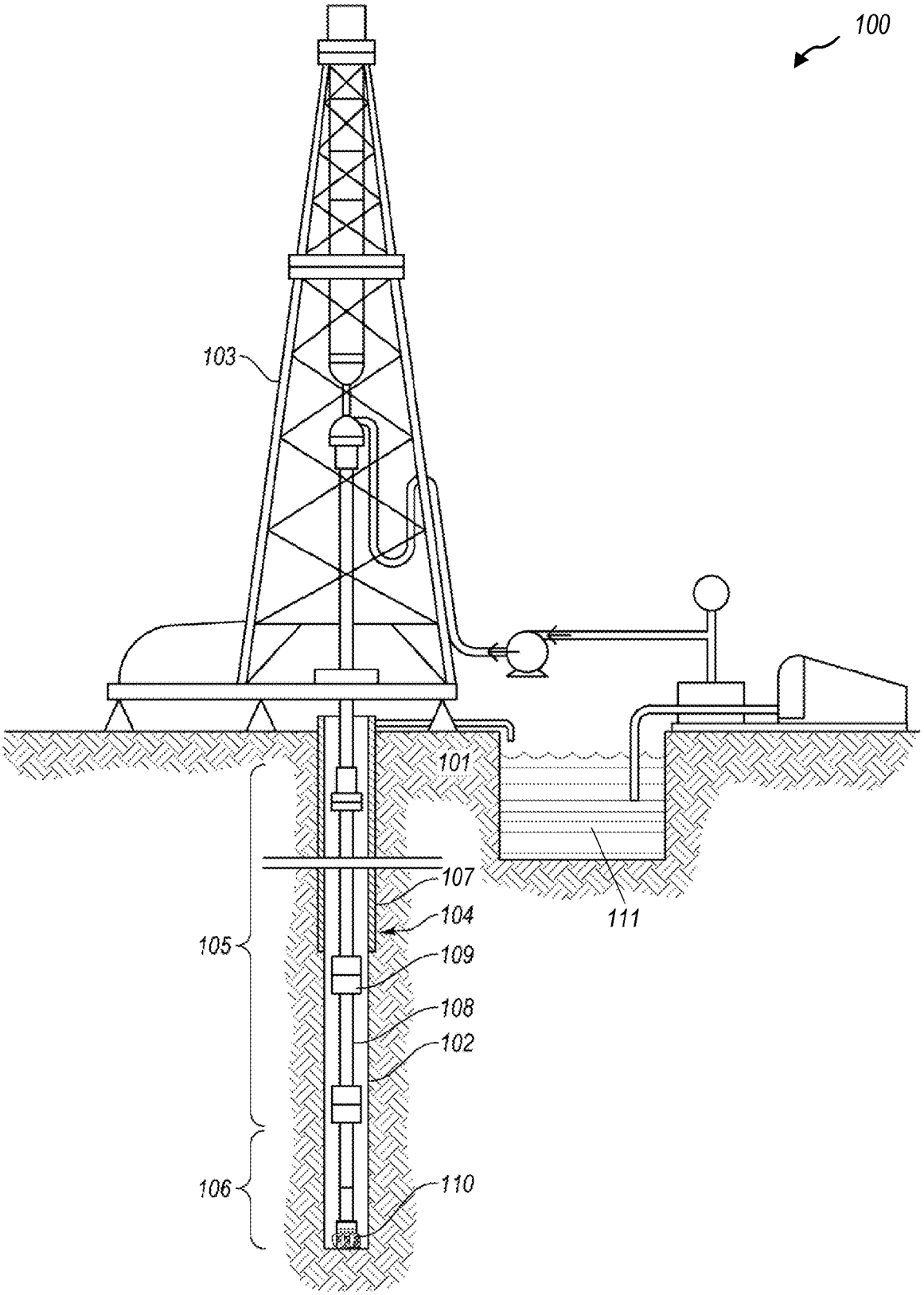
FIG. 1 illustrates an embodiment of a drilling system and downhole environment in which a drill bit, according to the present disclosure, may be used.

Embodiments of the present disclosure generally relate to devices, systems, and methods for drilling in an earth formation. More particularly, some embodiments of the present disclosure relate to hybrid drill bits for degrading and/or removing material from the earth formation. In some embodiments, a drill bit includes a roller cone and a fixed blade in sequence to crack, crush, deform, or otherwise degrade the material of the earth formation before removing the degraded material. In some embodiments, the roller cone rolls across a surface of the formation material of the earth formation to apply a compression force and/or a shear force to degrade the formation material into a degraded material, and the fixed blade drags across or through the degraded material to remove at least a portion of the degraded material.

In some embodiments, a drill bit according to the present disclosure includes a bit body with a rotational axis. The roller cone is supported by the bit body and rotatable around a cone axis that is oriented substantially radially to the rotational axis of the bit body, such that the roller cone rotates around the cone axis while the bit body rotates around the rotational axis. In some embodiments, the drill bit further includes a fixed blade that is fixed relative to and/or integrally formed with the bit body. The roller cone and the fixed blade each include a plurality of cutting elements affixed thereto.

In some embodiments, the roller cone has a plurality of regions in the axial direction of the cone axis (i.e., the axis around which the roller cone rotates as the bit body rotates around the rotational axis). In some embodiments, the roller cone includes a cone region proximate to a first axial end of the cone axis and proximate to the rotational axis of bit body. The roller cone includes a nose region adjacent to and radially outward from the cone region (relative to the rotational axis of the bit body). The roller cone includes a shoulder region adjacent to and radially outward from the nose region (relative to the rotational axis of the bit body). The roller cone includes a gauge region adjacent to and radially outward from the shoulder region (relative to the rotational axis of the bit body).

As will be described in more detail herein, a drill bit experiences the greatest torque on cutting elements in the shoulder region and/or an outer region of the cutting profile of the drill bit. In some embodiments, more aggressive degrading of formation material in the shoulder region by the roller cone reduces the torque experienced at the shear cutting elements of the fixed blades of the drill bit. Adjusting the cutting insert exposure (e.g., height above the fixed cutting element profile) of the roller cone can improve a rate of penetration relative to torque on the shear cutting elements of the fixed blades to limit failures of cutting elements experiencing high forces and/or torques. In some embodiments, the cutting insert exposure is at least partially based with the dimensions and/or positions of the primary, secondary, and tertiary fixed blades. In some embodiments, a drill bit according to the present disclosure can remove material in challenging earth formations with greater drilling rate, less torque, greater weight-on-bit, less wear or damage to the drill bit, or combinations thereof relative to conventional drag bits or fixed blade drill bits.

FIG. 1 illustrates an embodiment of a drilling system and downhole environment in which a drill bit, according to the present disclosure, may be used. FIG. 1 shows one example of a drilling system 100 for drilling an earth formation 101 to form a wellbore 102. The drilling system 100 includes a drill rig 103 used to turn a drilling assembly 104 which extends downward into the wellbore 102. The drilling assembly 104 may include a drill string 105 and a bottom-hole assembly (BHA) 106 attached to the downhole end of the drill string 105. Where the drilling system 100 is used for drilling formation, a drill bit 110 can be included at the downhole end of the bottom hole assembly or BHA 106.

The drill string 105 may include several joints of drill pipe 108 connected end-to-end through tool joints 109. The drill string 105 transmits drilling fluid through a central bore and can transmit rotational power from the drill rig 103 to the BHA 106. In some embodiments, the drill string 105 may further include additional components such as subs, pup joints, etc. The drill pipe 108 provides a hydraulic passage through which drilling fluid 111 is pumped from the surface. The drilling fluid 111 discharges through selected-size nozzles, jets, or other orifices in the bit 110 for the purposes of cooling the bit 110 and cutting structures thereon, for lifting cuttings out of the wellbore 102 as it is being drilled, and for preventing the collapse of the wellbore 102. The drilling fluid 111 carries drill solids including drill fines, drill cuttings, and other swarf from the wellbore 102 to the surface. The drill solids can include components from the earth formation 101, the drilling assembly 104 itself, from other man-made components (e.g., plugs, lost tools/components, etc.), or combinations thereof.

The BHA 106 may include the bit 110 or other components. An example BHA 106 may include additional or other components (e.g., coupled between to the drill string 105 and/or the bit 110). Examples of additional BHA components include drill collars, stabilizers, measurement-while-drilling (MWD) tools, logging-while-drilling (LWD) tools, downhole motors, underreamers, directional steering tools, section mills, hydraulic disconnects, jars, vibration dampening tools, other components, or combinations of the foregoing.

In general, the drilling system 100 may include other drilling components and accessories, such as special valves (e.g., kelly cocks, blowout preventers, safety valves, centrifuges, shaker tables, and rheometers). Additional components included in the drilling system 100 may be considered a part of the surface system (e.g., drill rig 103, drilling assembly 104, drill string 105, or a part of the BHA 106, depending on their locations and/or use in the drilling system 100).

The bit 110 in the BHA 106 includes any features or elements suitable for degrading downhole materials. For instance, the bit 110 may be a drill bit suitable for drilling the earth formation 101. While embodiments of a drill bit 110 for drilling the earth formation 101 will be described herein, it should be understood that, in some embodiments, features described herein are applicable to a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface by the drilling fluid 111 or may be allowed to fall downhole. The conditions of the equipment of the drilling system 100, the formation 101, the wellbore 102, the drilling fluid 111, or other parts of the wellsite can change during operations.

Figure 2:
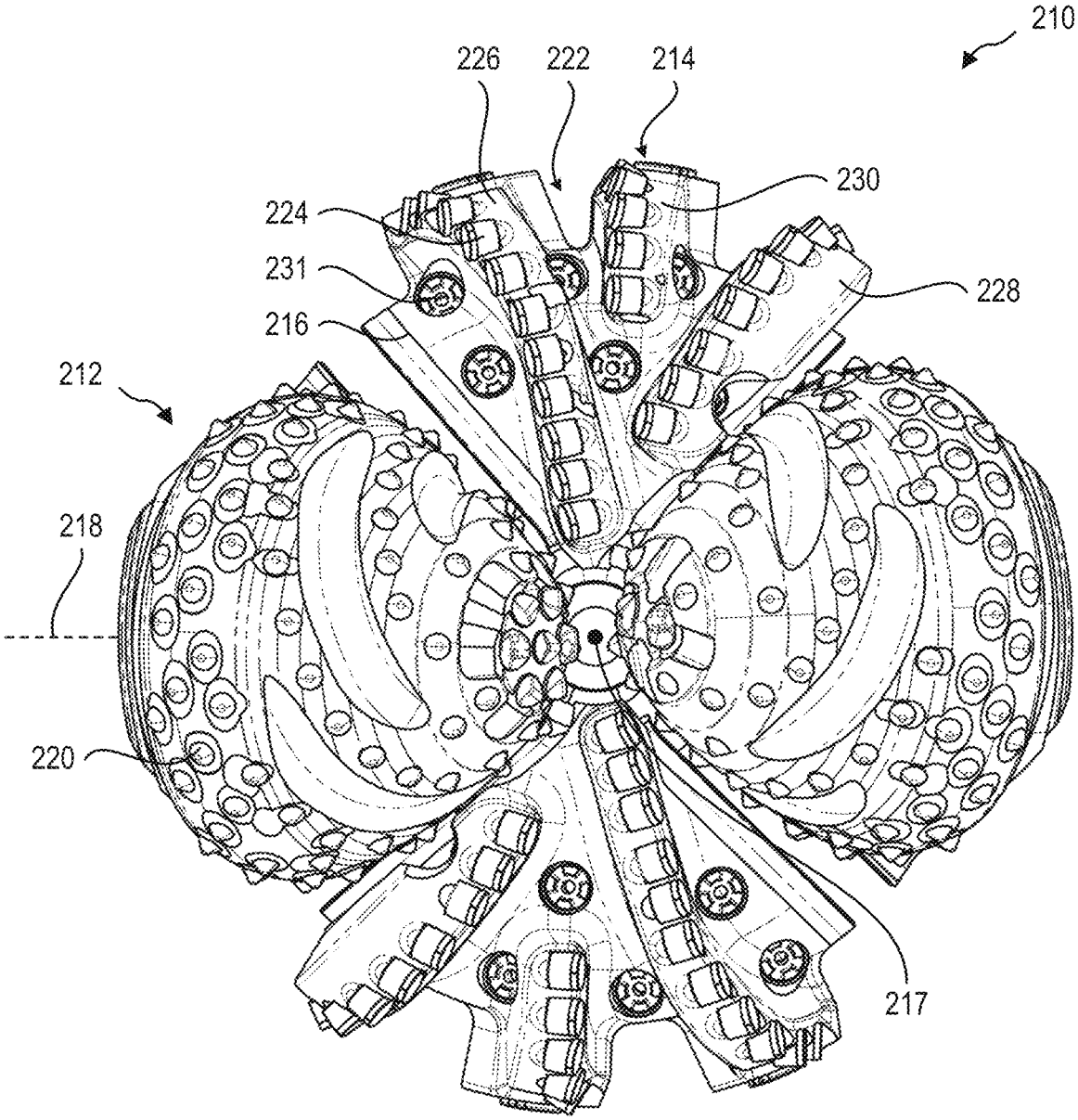
FIG. 2 is a bottom view of a hybrid drill bit with a roller cone and a fixed blade, according to at least some embodiments of the present disclosure.

FIG. 2 is a bottom view of an embodiment of a hybrid drill bit 210 with a roller cone 212 and a fixed blade 214. In some embodiments, the roller cone 212 is supported by a bit body 216. As the bit body 216 rotates around a rotational axis 217 of the drill bit 210, contact between the roller cone 212 and the formation material produces a rotation of the roller cone 212 around the cone axis 218. In some embodiments, the cone axis 218 is oriented with an outward component that is substantially radial to the rotational axis 217. In some embodiments, the cone axis 218 is oriented with an outward component that is raked relative to the radial direction and a rotational direction of the rotational axis 217. In some examples, a raked cone axis 218 increases a shear force between cutting elements of the roller cone 212 and the formation material as the drill bit 210 and roller cone 212 rotates.

In some embodiments, a cutting element of the roller cone(s) 212 and/or the fixed blade(s) 214, including but not limited to a shear cutting element, an apexed cutting element (conical, bullet, ridged), or another cutting element with another surface geometry, applies a force to the degraded material to remove at least a portion of the degraded material. In some embodiments, the cutting element is a spinning cutting element that allows the cutting element (such as a shear cutting element) to spin in a housing and expose different cutting surfaces to the formation. In some embodiments, the cutting element(s) is made of or includes a polycrystalline diamond compact (PDC). In some embodiments, the cutting element(s) is made of or includes a carbide, such as tungsten carbide. As will be described herein, the cutting elements may have different compositions and/or material properties related to the location of the cutting element in the roller cone 212 and/or fixed blade 214.

In some embodiments, the roller cone cutting inserts 220 affixed to the roller cone 212 are or include apexed cutting elements. For example, the roller cone cutting inserts 220 may have an apexed geometry, such as a conical cutting element, a bullet cutting element (i.e., curved conical surface), or a ridge or axe cutting element. As the roller cone 212 rotates around the cone axis 218, the roller cone cutting inserts 220 apply a compression force to the formation material with a relatively high pressure at the apex of the apexed cutting element to degrade the formation material. In some embodiments, the roller cone cutting inserts 220 are press fit, compression fit, mechanically fastened, adhered, brazed, or otherwise affixed to the roller cone 212.

In some embodiments, the bit body 216 has fixed blades 214 affixed thereto and/or integrally formed therewith. The fixed blades 214 have slots 222 therebetween. In some embodiments, the fixed blade cutting elements 224 affixed to the fixed blades 214 are or include shear cutting elements. For example, the fixed blade cutting elements 224 may have a substantially perpendicular or flat geometry, such as a cylindrical shear cutting element or angled shear cutting element. As the bit body 216 rotates around the rotational axis 217, the fixed blade cutting elements 224 apply a shear force to the formation material to degrade and/or remove the formation material. In some embodiments, the fixed blade cutting elements 224 are press fit, compression fit, mechanically fastened, adhered, brazed, or otherwise affixed to the fixed blade(s) 214.

In some embodiments, the drill bit 210 has sets of fixed blades 214 that can include a plurality of fixed blades 214 of different geometries that can be designed to cluster the fixed blade cutting elements 224 together with slots 222 therebetween. For example, a set of fixed blades 214 may include a primary blade 226 with fixed blade cutting elements 224 arranged from a gauge surface of the drill bit cutting profile to proximate the rotational axis 217 in the cone of the drill bit cutting profile. In some examples, a secondary blade 228 may include fixed blade cutting elements 224 arranged in a shorter portion of the radial distance relative to the rotational axis 217, such as from the gauge surface of the drill bit cutting profile to the nose of the drill bit cutting profile. In some examples, a secondary blade 230 may include fixed blade cutting elements 224 arranged in less of the radial distance relative to the rotational axis 217 than the secondary blade 228, such as from the gauge surface of the drill bit cutting profile to the shoulder of the drill bit cutting profile.

In some embodiments, the primary blade 226 and the secondary blade 228 have a slot 222 therebetween that allows fluid flow between the blades to clear cuttings, swarf, or other debris. In some embodiments, a hydraulic nozzle 231 directs a fluid flow, such as a drilling fluid flow, into the slot to clear the cuttings, swarf, or other debris. In some embodiments, degraded material remains in the degraded formation after the fixed blade cutting elements 224 of the primary blade 226 remove material from the formation. The fluid flow can further dislodge or flush remaining degraded material from the formation to further assist the second plurality of fixed blade cutting elements 224 of the secondary blade 228 further degrading and/or removing material.

In some embodiments, a cutting insert exposure of the roller cone cutting inserts 220 varies on the roller cone 212 in a radial direction relative to the rotational axis 217 of the drill bit 210. In some embodiments, the cutting insert exposure can vary based at least partially on the location and arrangement of fixed blade cutting elements 224 on the fixed blades 214 of the hybrid drill bit 210. In at least some embodiments, by degrading the formation material by difference amounts (relative to a radial direction) with the roller cone 212, torque on the fixed blade cutting elements 224 is reduced and/or balanced to allow more efficient removal of formation material by the fixed blade cutting elements 224.

Figures 1, 3:
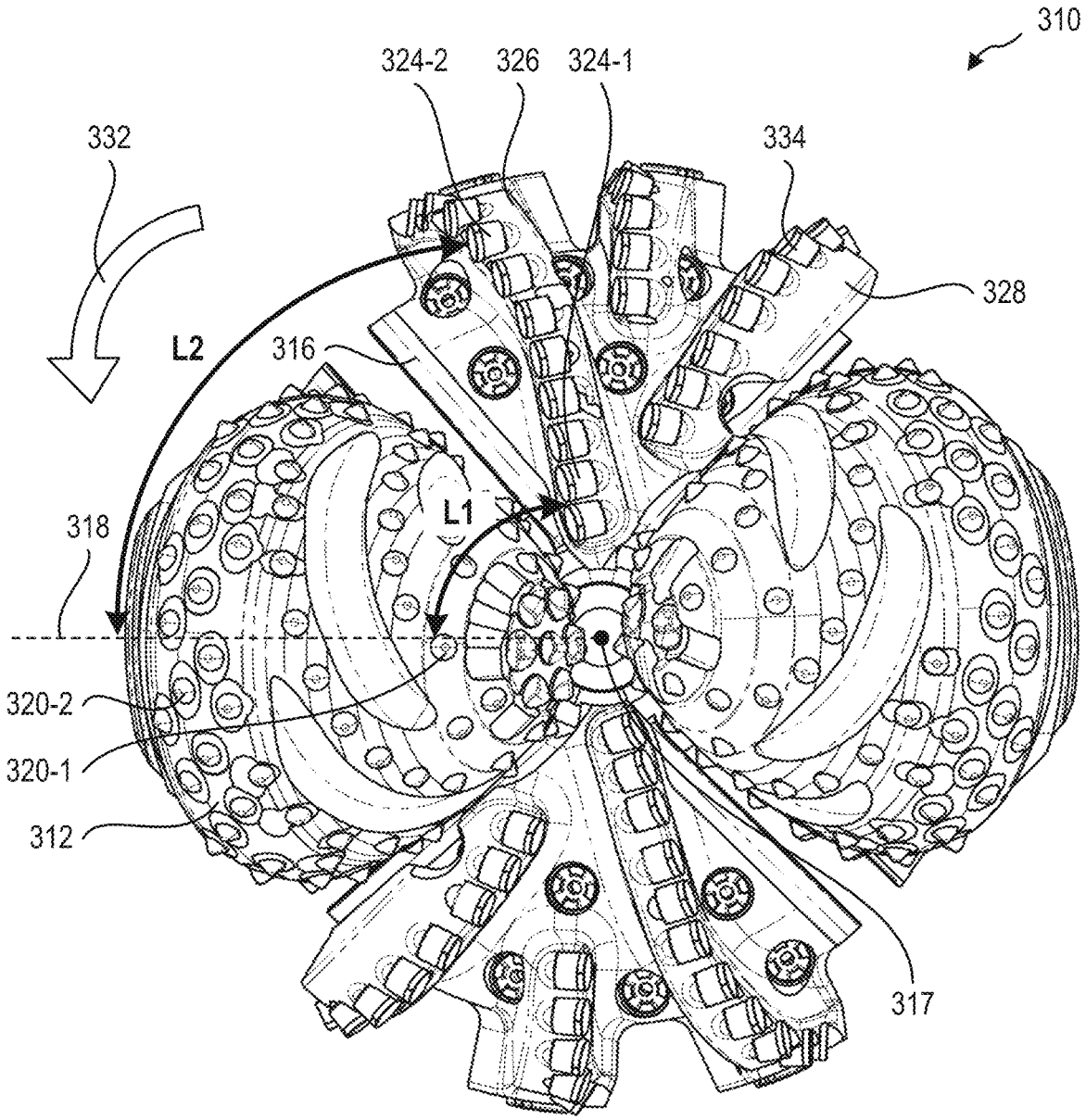
Figures 2, 3:
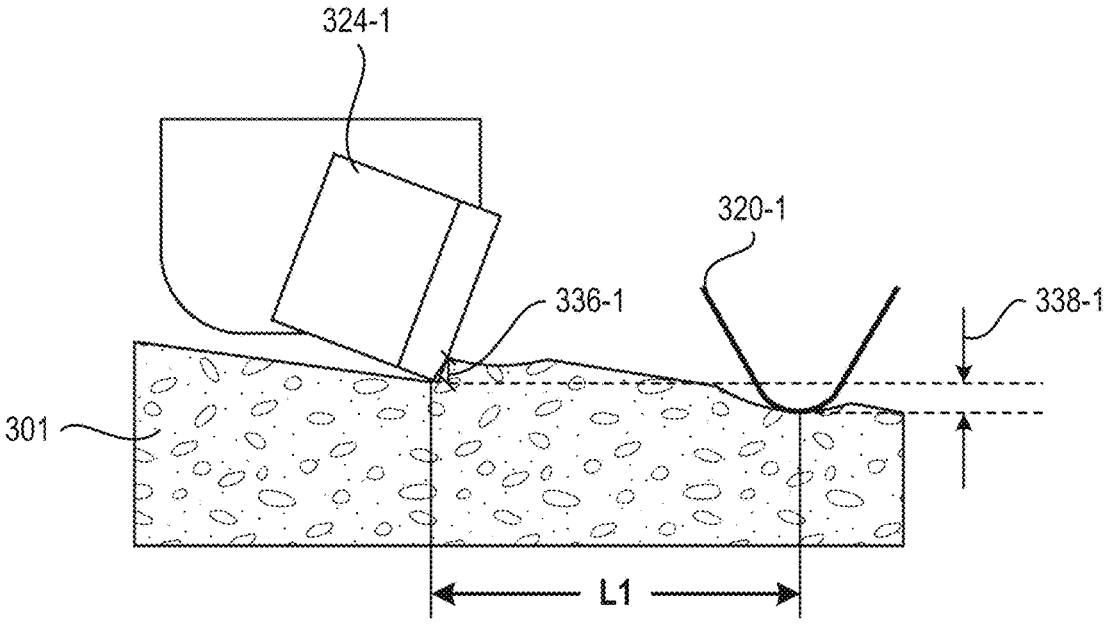
Figure 3:
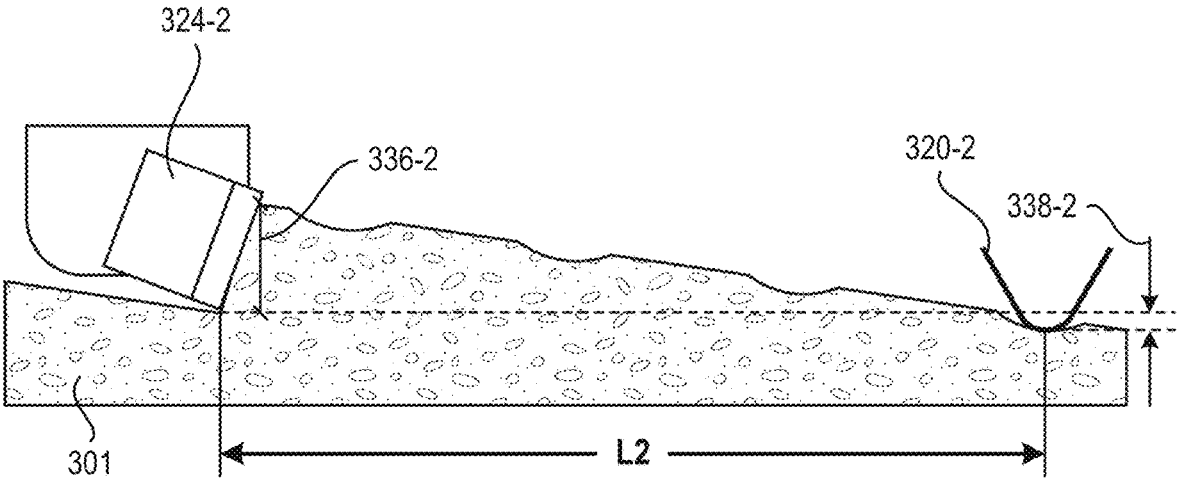

FIG. 3-1 is a bottom view of another embodiment of a hybrid drill bit 310 including a plurality of roller cones 312 with a primary blade 326 and a secondary blade 328. In some embodiments, the drill bit 310 includes a bit body 316 that is rotatable around a bit axis 317, and a roller cone 312 is rotatable around a cone axis 318 based on the rotation of the bit body 316. In some embodiments, the roller cone 312 includes a plurality of cutting inserts 320-1, 320-2 located on the outer surface of the roller cone 312. As the roller cone 312 rotates around the cone axis 318 during rotation of the bit body 316 around the bit axis 317, the plurality of cutting inserts 320-1, 320-2 contact the formation surface and degrade the formation surface.

In some embodiments, the hybrid drill bit 310 includes a primary blade 326 rotationally fixed relative to the bit body 316. The primary blade 326 includes a plurality of primary fixed cutting elements 324-1, 324-2 that are positioned on the primary blade 326 and configured to contact the formation after the cutting inserts 320-1, 320-2 of the roller cone 312 have degraded the formation. For example, the primary blade 326 is located rotationally behind the roller cone 312 in the rotational direction 332 of the drill bit 310. As the drill bit 310 rotates in the rotational direction 332, the roller cone 312 rotates around the cone axis 318 and rolls the cutting inserts 320-1, 320-2 against the formation surface. During the rotation of the roller cone 312 relative to the formation surface, the cutting inserts 320-1, 320-2 are pressed into the formation surface, and little to no shear force is applied by the cutting inserts 320-1, 320-2 of the roller cone 312.

In some embodiments, the primary fixed cutting elements 324-1, 324-2 contact and apply a shear force to the degraded formation surface to remove the formation material and propagate the borehole further in the downhole direction. In some embodiments, at least some of the primary fixed cutting elements 324-1, 324-2 are rotationally-aligned with cutting inserts 320-1, 320-2 of the roller cone 312. In such embodiments, the primary fixed cutting elements 324-1, 324-2 are positioned to follow immediately after the cutting insert 320 and remove the degraded formation material. In some embodiments, each of the primary fixed cutting elements 324-1, 324-2 is rotationally-aligned with a cutting insert 320 of the roller cone 312.

For example, a first cutting insert 320-1 is located proximate to the bit axis 317 (e.g., near or in a cone region of the bit cutting profile, as will be discussed in more detail herein) and configured to degrade the formation material in the rotational path (e.g., in the rotational direction 332) of the first primary fixed cutting element 324-1. In another example, a second cutting insert 320-2 is located distal to the bit axis 317 (e.g., near or in a shoulder region of the bit cutting profile, as will be discussed in more detail herein) and configured to degrade the formation material in the rotational path (e.g., in the rotational direction 332) of the second primary fixed cutting element 324-2.

In some embodiments, the drill bit 310 further includes a secondary blade 328 that supports a plurality of secondary fixed cutting elements 334 that are rotationally aligned with one or more cutting inserts 320-1, 320-2 of the roller cone 312 in the rotational direction 332 of the drill bit 310. In some examples, each of the secondary fixed cutting elements 334 are radially positioned (i.e., in a radial distance from the bit axis 317) offset from the primary fixed cutting elements 324-1, 324-2. In at least one example, each cutting insert 320-1, 320-2 of the roller cone 312 is rotationally-aligned with a fixed cutting element of either the plurality of primary fixed cutting elements 324-1, 324-2 or the secondary fixed cutting elements 334 to remove the formation material after the cutting inserts 320-1, 320-2 degrades the formation material.

The cutting inserts 320-1, 320-2 degrade the formation material by crushing, fracturing, or pushing the formation material to create unsupported material or less-supported material in the formation surface. The unsupported material or less-supported material in the formation surface then chips or breaks away from the shear force applied by the fixed cutting elements 324-1, 324-2, 334 with less force applied than supported material (e.g., without the roller cone 312 and cutting inserts 320-1, 320-2). In some embodiments, to ensure the fixed cutting elements 324-1, 324-2, 334 are contacting the unsupported or less supported material, the cutting inserts 320-1, 320-2 are positioned and/or configured to protrude farther or above the fixed cutting elements 324-1, 324-2, 334 when the bit cutting profile of all cutting inserts and/or elements is superimposed by being rotated into a single plane around the bit axis 317. In some embodiments, the exposure may vary by the radial distance from the bit axis 317.

FIG. 3-2 is a schematic representation of a first primary fixed cutting element 324-1 at the L1 radial position of FIG. 3-1 removing formation material 301 after a first cutting insert 320-1 degrades the formation material 301. In such an example, the first cutting insert 320-1 is positioned on the roller cone and/or drill bit with a first exposure 338-1 above (relative to the bit body) the first primary fixed cutting element 324-1 of approximately 0.020 inches. The resulting first depth of cut (DOC) 336-1 of the first primary fixed cutting element 324-1 after the angular distance L1 is based at least partially on the first exposure 338-1 above the first primary fixed cutting element 324-1.

FIG. 3-3 is a schematic representation of a second primary fixed cutting element 324-2 at the L2 radial position of FIG. 3-1 removing formation material 301 after a second cutting insert 320-2 degrades the formation material 301. In such an example, the second cutting insert 320-2 is positioned on the roller cone and/or drill bit with a second exposure 338-2 above (relative to the bit body) the second primary fixed cutting element 324-2 of approximately 0.020 inches. The resulting second DOC 336-2 of the second primary fixed cutting element 324-2 after rotating the angular distance L2 is substantially greater than the first DOC 336-1.

In some embodiments, the force experienced by the fixed cutting elements of the primary blade and/or the secondary blade increases as the DOC of the individual cutting elements increases. In some embodiments, the exposure of the radially-outward cutting inserts is increased relative to the exposure of the radially-inward cutting inserts of the roller cone to degrade the formation material more deeply and provide more unsupported and/or less-supported formation material for the radially-outward fixed cutting elements.

Figures 1, 4:
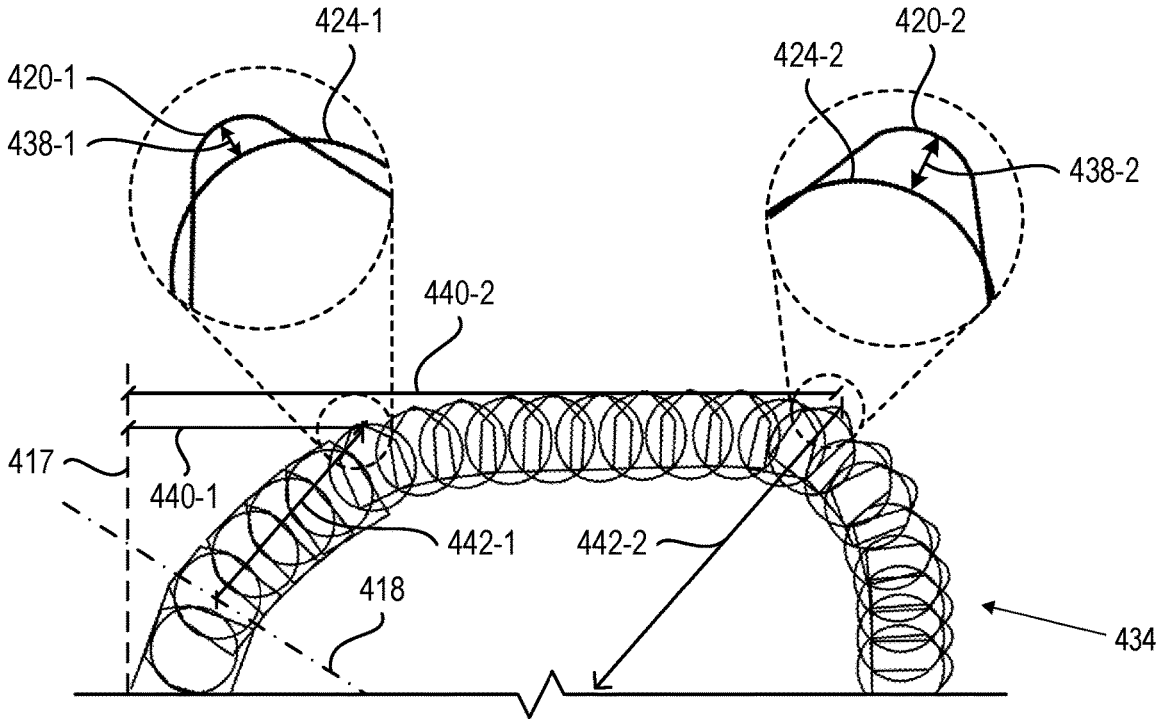
Figures 2, 4:
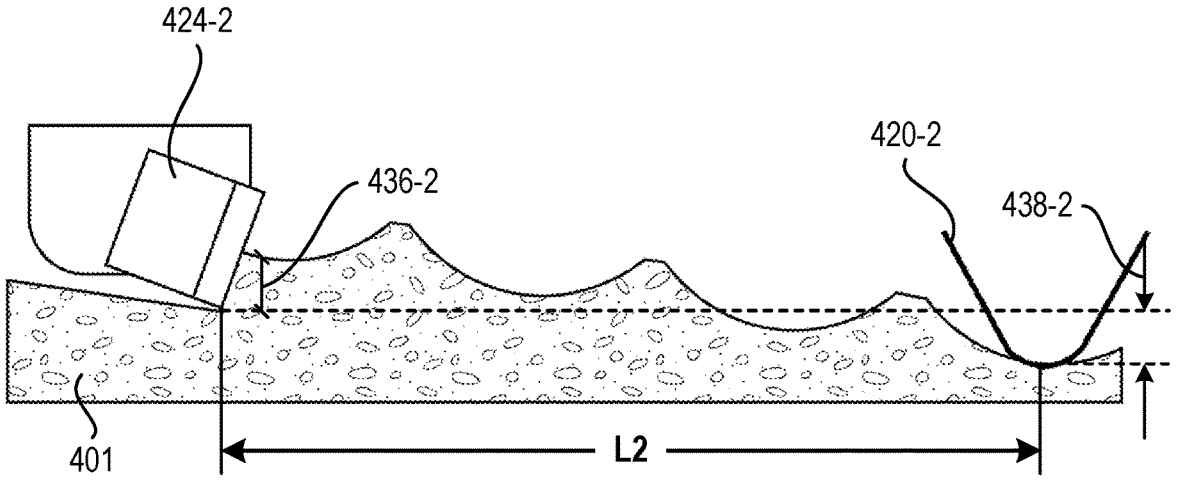

FIG. 4-1 is a bit cutting profile 434 of a hybrid drill bit, such as that described in relation to any of FIG. 2 through FIG. 3-3, including a comparison of a fixed cutting profile consisting of fixed cutting elements 424-1, 424-2 and a rolling cutting profile of roller cone cutting inserts 420-1, 420-2 superimposed by being rotated into a single plane, according to at least some embodiments of the present disclosure.

In some embodiments, the bit cutting profile is relative to the bit axis 417 around which the drill bit rotates. As described in relation to FIG. 3-3, the exposure of the cutting insert above the rotationally-aligned fixed cutting element may vary based at least partially on a radial position of the pair of rotationally-aligned cutting insert and fixed cutting element. In some embodiments, the bit cutting profile (including the rolling cutting profile and the fixed cutting profile) includes a nose region adjacent to and radially outward from a cone region (relative to the bit axis 417 of the bit body). In some examples, the cone region is closest to the bit axis 417 and may be concave. In some examples, the nose region is the apex region of the bit cutting profile and may be approximately 50% to 75% of the outer diameter of the bit. In some embodiments, the bit cutting profile includes a shoulder region adjacent to and radially outward from the nose region (relative to the bit axis 417 of the bit body). In some examples, the shoulder region is a transition region between the nose region and a gauge region. In some embodiments, the bit cutting profile includes a gauge region adjacent to and radially outward from the shoulder region (relative to the rotational axis of the bit body), which contacts the wellbore walls.

In some embodiments, a first pair of rotationally aligned cutting elements includes a first fixed cutting element 424-1 and a first cutting insert 420-1 located at a proximate end of the nose region of the bit cutting profile, and a second pair of rotationally aligned cutting elements includes a second fixed cutting element 424-2 and a second cutting insert 420-2 located at a distal end of the nose region of the bit cutting profile. In some embodiments, the first pair of cutting elements is located in the cone region. In some embodiments, the second pair of cutting elements is located in the shoulder region. In some embodiments, the second pair of cutting elements is located at a distal end of the shoulder region radially away from the bit axis 417. In some embodiments, the first pair is located at a first bit radial distance 440-1, and the second pair is located at a second bit radial distance 440-2.

In some embodiments, the first pair of cutting elements has a first exposure 438-1 between the first cutting insert 420-1 and the first fixed cutting element 424-1, and the second pair of cutting elements has a second exposure 438-2 between the second cutting insert 420-2 and the second fixed cutting element 424-2. The second exposure 438-2 is greater than the first exposure 438-1. In at least one embodiment, the second exposure 438-2 is at least three times greater than the first exposure 438-1. For example, the first exposure 438-1 may be 0.02 inches and the second exposure 438-2 may be no less than 0.06 inches. In some embodiments, the exposure of each pair of rotationally-aligned cutting elements between the first pair and the second pair increases with bit radial distance from the bit axis 417. In some embodiments, the exposure of each pair of rotationally-aligned cutting elements between the first pair and the second pair increases proportionately with bit radial distance from the bit axis 417. In some embodiments, the exposure of each pair of rotationally-aligned cutting elements between the first pair and the second pair increases linearly with bit radial distance from the bit axis 417. In some embodiments, the exposure of each pair of rotationally-aligned cutting elements between the first pair and the second pair increases non-linearly with bit radial distance from the bit axis 417.

In some embodiments, the exposure of each pair of rotationally-aligned cutting elements between the first pair and the second pair increases with cone radial distance from the cone axis 418. For example, the first pair may be located at a first cone radial distance 442-1 from the cone axis 418, and the second pair may be located at a second cone radial distance 442-2 from the cone axis 418. In some embodiments, the exposure of each pair of rotationally-aligned cutting elements between the first pair and the second pair increases proportionately with cone radial distance from the cone axis 418. In some embodiments, the exposure of each pair of rotationally-aligned cutting elements between the first pair and the second pair increases linearly with cone radial distance from the cone axis 418. In some embodiments, the exposure of each pair of rotationally-aligned cutting elements between the first pair and the second pair increases non-linearly with cone radial distance from the cone axis 418.

FIG. 4-2 is a schematic representation of fixed cutting element at the radially-outward end of the nose region (e.g., at the L2 distance of FIG. 3-1) removing formation material after a rolling cutting insert with a relatively high exposure degrades the formation material. In some embodiments, the increased second exposure 438-2 of the radially outward pairs of cutting elements allows the second cutting insert 420-2 to have a greater penetration into the formation 401 and create more unsupported (or less-supported) material for the second fixed cutting element 424-2 of the pair. The second fixed cutting element 424-2, therefore, may experience a lower average DOC 436-2 that reduces the force experienced by the second fixed cutting element 424-2. In some embodiments, reducing the force experienced by the second fixed cutting element 424-2 increases the operational lifetime of the second fixed cutting element 424-2. In some embodiments, reducing the force experienced by the second fixed cutting element 424-2 produces a more balanced distribution of force across the cutting elements, improving the rate of penetration (ROP) of the drill bit.

As described herein, the exposure of a pair of rotationally-aligned cutting elements in a drill bit may increase with increasing radial distance. In some embodiments, the radial distance is a bit radial distance from the bit axis. In some embodiments, the radial distance is a cone radial distance from the cone axis. In some embodiments, the exposure of a pair of rotationally-aligned cutting element in a drill bit may be based at least partially on an angular distance between the cutting elements of the pair. In some embodiments, the exposure of a pair of rotationally-aligned cutting element in a drill bit may be based at least partially on the radial distance of the pair of cutting elements and at least partially on an angular distance between the cutting elements of the pair.

Figure 5:
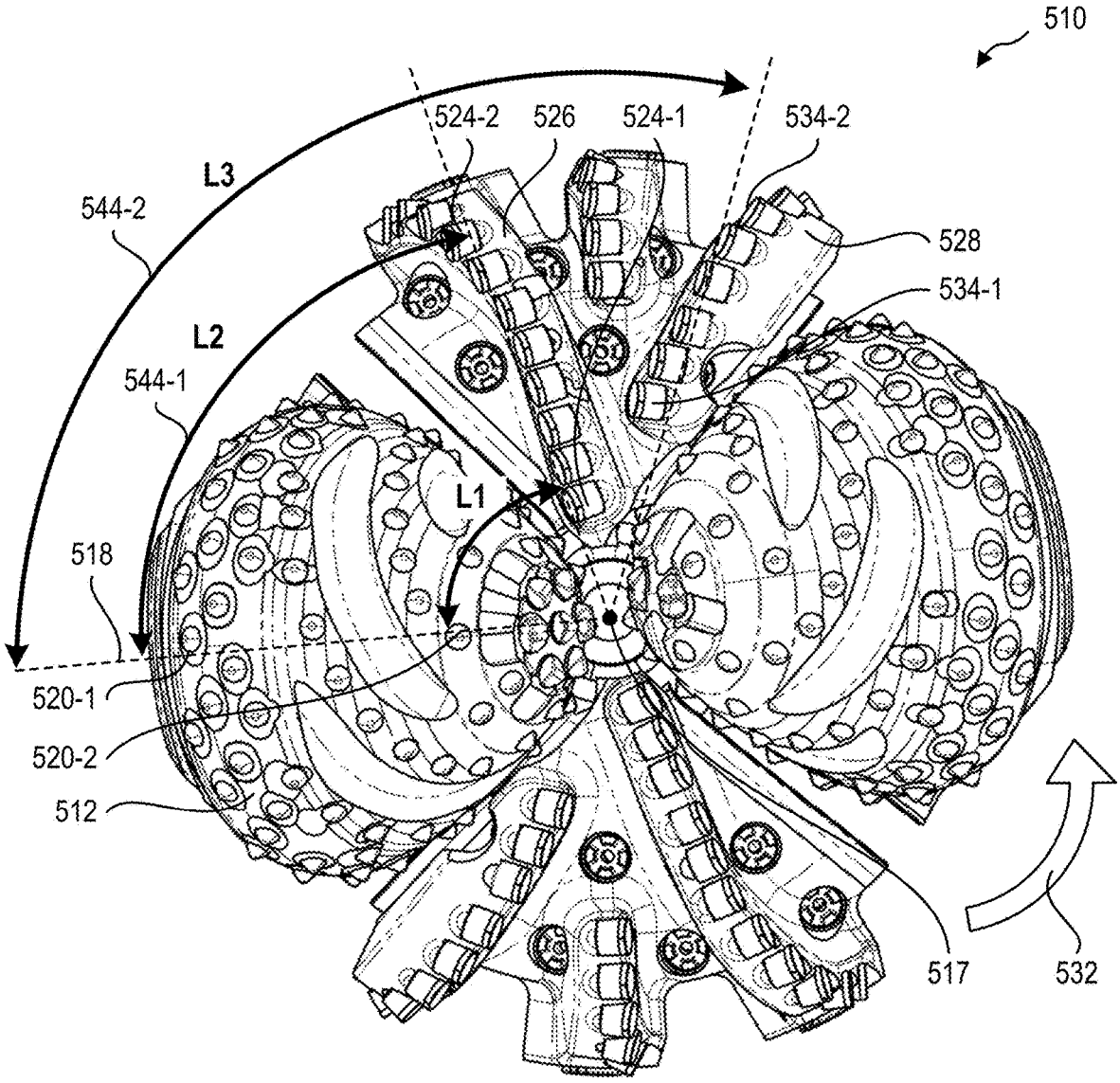
FIG. 5 is a bottom view of a hybrid drill bit including a plurality of roller cones with a primary blade and a secondary blade trailing each of the roller cones in the rotational direction around the bit axis, according to at least some embodiments of the present disclosure.

FIG. 5 is a bottom view of an embodiment of a hybrid drill bit 510 including a plurality of roller cones 512 with a primary blade 526 and a secondary blade 528 trailing each of the roller cones 512 in the rotational direction 532 around the bit axis 517. In some embodiments, the roller cone 512 includes a plurality of cutting inserts 520-1, 520-2 that degrade a formation before a plurality of primary fixed cutting elements 524-1, 524-2 supported by a primary blade 526 and a plurality of secondary fixed cutting element 534-1, 534-2 supported by the secondary blade 528 remove the degraded formation material.

As described herein, in some embodiments, a first exposure of a first cutting insert 520-1 relative to a first primary fixed cutting element 524-1 is less than a second exposure of a second cutting insert 520-2 relative to a second primary fixed cutting element 524-2. In some embodiments, both the first pair of cutting elements and second pair of cutting elements described above have substantially similar angular distances (e.g., first angular distance 544-1 of both L1 and L2) from one another as both of the primary fixed cutting elements 524-1, 524-2 are located on the primary blade 526 and the cutting inserts 520-1, 520-2 contact the formation substantially axially downhole from the cone axis 518 as the roller cone 512 rotates.

In some embodiments, the exposure of a rotationally-aligned pair of cutting elements increases with increasing angular distance, such as the L3 distance between the cutting inserts 520-1, 520-2 of the roller cone 512 and the secondary cutting elements 534-1, 534-2 of the secondary blade 528. In some embodiments, a primary pair of cutting elements, such as the second cutting insert 520-2 and the second primary fixed cutting element 524-2 has a different exposure than a secondary pair of cutting elements that are similarly radially positioned, such as a cutting insert adjacent to the second cutting insert 520-2 and the second secondary fixed cutting element 534-2 on the secondary blade 528. The primary pair has a first angular distance 544-1 and the secondary pair have a second angular distance 544-2.

In some embodiments, the exposure of a rotationally-aligned pair of cutting elements increases with increasing angular distance. For example, the exposure of a secondary fixed cutting element 534-1, 534-2 on the secondary blade 528 may be greater than the exposure of a primary fixed cutting element 524-1, 524-2 on the primary blade 526 at a substantially similar radial distance. In some embodiments, the exposure of a rotationally-aligned pair of cutting elements decreases with increasing angular distance. For example, the exposure of a secondary fixed cutting element 534-1, 534-2 on the secondary blade 528 may be less than the exposure of a primary fixed cutting element 524-1, 524-2 on the primary blade 526 at a substantially similar radial distance.

Figure 6:
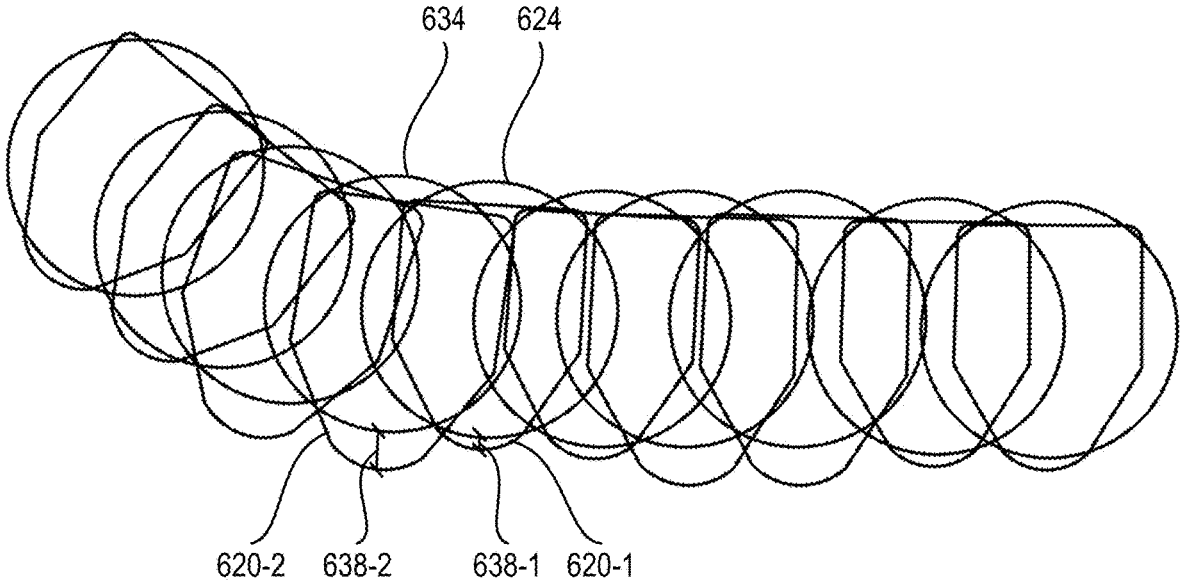
FIG. 6 is a composite cutting profile of a rolling cutting profile, a primary fixed cutting profile, and a secondary fixed cutting profile, according to at least some embodiments of the present disclosure.

In some embodiments, the exposure of a pair of cutting elements is adjusted by varying the position of the fixed cutting element in the bit cutting profile while the cutting inserts remains at a substantially constant protrusion along the roller cone surface. In some embodiments, the fixed cutting elements that form the fixed cutting profile have a substantially constant height above the blade to form a substantially continuous cutting profile while the cutting inserts vary in height. FIG. 6 is a composite cutting profile of a rolling cutting profile, a primary fixed cutting profile, and a secondary fixed cutting profile.

In some embodiments, the cutting inserts 620-1, 620-2 vary in height above the surface of the roller cone based on a desired exposure of the cutting insert 620-1, 620-2 relative to the rotationally-aligned primary fixed cutting element 624 or secondary fixed cutting element 634 that is located rotationally-behind the cutting insert 620-1, 620-2. In some examples, a first cutting insert 620-1 is part of a rotationally-aligned pair with a primary fixed cutting element 624 that is located on a primary blade (with a first angular distance therebetween) and a second cutting insert 620-2 is part of a rotationally-aligned pair with a secondary fixed cutting element 634 that is located on a secondary blade (with a second angular distance therebetween). In such an example, the first pair has a first exposure 638-1 that is less than the second exposure 638-2 of the second pair.

In at least some embodiments according to the present disclosure, rotationally-aligned pairs of cutting elements have different exposure between the leading cutting insert and the trailing fixed cutting element of the pair. In some embodiments, the exposure varies by radial distance of the pair. In some embodiments, the exposure varies by angular distance between the cutting elements of the pair. In at least some embodiments, the rotationally-aligned pairs of cutting elements have different exposure between the leading cutting insert and the trailing fixed cutting element of the pair, which increases the operational lifetime of radially-outward fixed cutting elements. In at least some embodiments, the rotationally-aligned pairs of cutting elements have different exposure between the leading cutting insert and the trailing fixed cutting element of the pair, which balances forces across cutting elements and increases the ROP of the drill bit.

INDUSTRIAL APPLICABILITY

The following description below includes various embodiments that, where feasible, may be combined in any permutation. For example, the embodiment in the next paragraph may be combined with any or all embodiments of the following paragraphs. Embodiments that describe acts of a method may be combined with embodiments that describe, for example, systems and/or devices. Any permutation of the following paragraphs is considered to be hereby disclosed for the purposes of providing "unambiguously derivable support" for any claim amendment based on the following paragraphs. Furthermore, the following paragraphs provide support such that any combination of the following paragraphs would not create an "intermediate generalization."

In some embodiments, a drill bit includes a bit body having a bit axis about which the bit body is configured to rotate in a rotational direction; a roller cone connected to the bit body and having a cone axis around which the roller cone is configured to rotate, the roller cone having a plurality of cutting inserts positioned in a surface of the roller cone, wherein the plurality of cutting inserts form a rolling cutting profile when rotated in around the cone axis; and a blade having a plurality of fixed cutting elements coupled thereto, wherein the plurality of fixed cutting elements define a fixed cutting profile, wherein the rolling cutting profile superimposes on the fixed cutting profile in the rotational direction of the bit body and the rolling cutting profile has an exposure above the fixed cutting profile in at least a nose region of the fixed cutting profile to a shoulder region of the fixed cutting profile and the exposure increases in a bit radial direction away from the bit axis.

In some embodiments, the rolling cutting profile has the exposure above the fixed cutting profile from at least a cone region of the fixed cutting profile to the shoulder region of the fixed cutting profile.

In some embodiments, the exposure increases proportionately to a bit radial distance from the bit axis.

In some embodiments, the exposure increases linearly based on a bit radial distance from the bit axis.

In some embodiments, the exposure increases in a cone radial direction away from the cone axis in the nose region.

In some embodiments, the exposure increases proportionately to a cone radial distance from the cone axis.

In some embodiments, the exposure increases linearly to a cone radial distance from the cone axis.

In some embodiments, the exposure of the rolling cutting profile at a radially-outward end of the nose region is at least three times the exposure at a radially-inward end of the nose region.

In some embodiments, the exposure increases in a radial direction away from the bit axis in the nose region and through the shoulder region.

In some embodiments, the exposure increases in a radial direction away from the cone axis in the nose region and through shoulder region.

In some embodiments, the blade is a primary blade and the plurality of fixed cutting elements are primary cutting element, and further comprising a secondary blade with a plurality of secondary fixed cutting elements thereon.

In some embodiments, each of the primary cutting elements and each of the secondary cutting elements in the nose region are rotationally-aligned with a cutting insert of the roller cone.

In some embodiments, a drill bit includes a bit body having a bit axis about which the bit body is configured to rotate in a rotational direction; a roller cone connected to the bit body and having a cone axis around which the roller cone is configured to rotate, the roller cone having a plurality of cutting inserts positioned in a surface of the roller cone, wherein the plurality of cutting inserts form a rolling cutting profile when rotated in around the cone axis; and a blade having a plurality of fixed cutting elements coupled thereto, wherein the plurality of fixed cutting elements define a fixed cutting profile, wherein the rolling cutting profile superimposes on the fixed cutting profile in the rotational direction of the bit body and the rolling cutting profile has an exposure above the fixed cutting profile in at least a nose region of the fixed cutting profile to a shoulder region of the fixed cutting profile and the exposure is at least partially based on an angular distance between a rotationally aligned pair of a cutting insert of the rolling cutting profile and a fixed cutting element of the fixed cutting profile.

In some embodiments, the blade is a primary blade.

In some embodiments, the blade is a secondary blade.

In some embodiments, the blade is a primary blade and the fixed cutting profile is a primary fixed cutting profile and the exposure is a primary exposure, and the drill bit further comprises: a secondary blade with a secondary fixed cutting profile defining a secondary exposure, wherein the secondary exposure is at least partially based on a secondary angular distance between a rotationally aligned pair of a cutting insert of the rolling cutting profile and a fixed cutting element of the secondary fixed cutting profile.

In some embodiments, the secondary exposure is greater than the primary exposure for radially adjacent fixed cutting elements.

In some embodiments, the secondary exposure is less than the primary exposure for radially adjacent fixed cutting elements.

In some embodiments, the exposure increases proportionately to the angular distance.

In some embodiments, a drill bit includes a bit body having a bit axis about which the bit body is configured to rotate in a rotational direction; a roller cone connected to the bit body and having a cone axis around which the roller cone is configured to rotate, the roller cone having a plurality of cutting inserts positioned in a surface of the roller cone, wherein the plurality of cutting inserts form a rolling cutting profile when rotated in around the cone axis; a primary blade having a plurality of primary fixed cutting elements coupled thereto, wherein the plurality of primary fixed cutting elements define a primary fixed cutting profile; and a secondary blade having a plurality of secondary fixed cutting elements coupled thereto, wherein the plurality of secondary fixed cutting elements define a secondary fixed cutting profile, wherein the rolling cutting profile superimposes on the primary fixed cutting profile and the secondary fixed cutting profile in the rotational direction of the bit body and the rolling cutting profile has a primary exposure above the primary fixed cutting profile and a secondary exposure above the secondary fixed cutting profile in at least a nose region to a shoulder region, and wherein the primary exposure is based at least partially on: a primary radial distance between a rotationally aligned primary pair of a cutting insert of the rolling cutting profile and a fixed cutting element of the primary fixed cutting profile, and a primary angular distance between the primary pair, and wherein the secondary exposure is based at least partially on: a secondary radial distance between a rotationally aligned secondary pair of a cutting insert of the rolling cutting profile and a fixed cutting element of the secondary fixed cutting profile, and a secondary angular distance between the secondary pair.

The embodiments of the cutting element(s) and cutting tools (e.g., drill bit) herein have been primarily described with reference to wellbore drilling operations; the cutting tool(s) described herein may be used in applications other than the drilling of a wellbore. In other embodiments, the cutting tool(s) according to the present disclosure may be used outside a wellbore or other downhole environment used for the exploration or production of natural resources. For instance, the cutting tool(s) of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements. Additionally, as used herein, the term "and/or" includes any and all combinations of one or more of the associated listed items.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A drill bit comprising:

a bit body having a bit axis about which the bit body is configured to rotate in a rotational direction;

a roller cone connected to the bit body and having a cone axis around which the roller cone is configured to rotate, the roller cone having a plurality of cutting inserts positioned in a surface of the roller cone, wherein the plurality of cutting inserts form a rolling cutting profile when rotated around the cone axis; and a blade having a plurality of fixed cutting elements coupled thereto, wherein the plurality of fixed cutting elements define a fixed cutting profile, wherein the rolling cutting profile superimposes on the fixed cutting profile in the rotational direction of the bit body and the rolling cutting profile has an exposure with respect to the fixed cutting profile in a nose region and a shoulder region of the fixed cutting profile such that the plurality of cutting inserts extend past the plurality of fixed cutting elements, wherein the exposure of the rolling cutting profile extends from the nose region of the fixed cutting profile and through the shoulder region of the fixed cutting profile, and wherein the exposure increases in a bit radial direction away from the bit axis.

2. The drill bit of claim 1, wherein the rolling cutting profile has the exposure from at least a cone region of the fixed cutting profile to the shoulder region of the fixed cutting profile.

3. The drill bit of claim 1, wherein the exposure increases proportionately to a bit radial distance from the bit axis.

4. The drill bit of claim 1, wherein the exposure increases linearly based on a bit radial distance from the bit axis.

5. The drill bit of claim 1, wherein the exposure increases in a cone radial direction away from the cone axis in the nose region.

6. The drill bit of claim 5, wherein the exposure increases proportionately to a cone radial distance from the cone axis.

7. The drill bit of claim 5, wherein the exposure increases linearly to a cone radial distance from the cone axis.

8. The drill bit of claim 1, wherein the exposure of the rolling cutting profile at a radially-outward end of the nose region is at least three times the exposure at a radially-inward end of the nose region.

9. The drill bit of claim 1, wherein the exposure increases in a radial direction away from the bit axis in the nose region and through the shoulder region.

10. The drill bit of claim 1, wherein the exposure increases in a radial direction away from the cone axis in the nose region and through the shoulder region.

11. The drill bit of claim 1, wherein the blade is a primary blade and the plurality of fixed cutting elements are a plurality of primary cutting elements, and further comprising a secondary blade with a plurality of secondary fixed cutting elements thereon.

12. The drill bit of claim 11, wherein each of the plurality of primary cutting elements and each of the plurality of secondary fixed cutting elements in the nose region are rotationally aligned with a cutting insert of the roller cone.

13. A drill bit comprising:

a bit body having a bit axis about which the bit body is configured to rotate in a rotational direction;

a roller cone connected to the bit body and having a cone axis around which the roller cone is configured to rotate, the roller cone having a plurality of cutting inserts positioned in a surface of the roller cone, wherein the plurality of cutting inserts form a rolling cutting profile when rotated around the cone axis; and a blade having a plurality of fixed cutting elements coupled thereto, wherein the plurality of fixed cutting elements define a fixed cutting profile, wherein the rolling cutting profile superimposes on the fixed cutting profile in the rotational direction of the bit body and the rolling cutting profile has an exposure with respect to the fixed cutting profile in a nose region and a shoulder region of the fixed cutting profile such that the plurality of cutting inserts extend past the plurality of fixed cutting elements, wherein the exposure of the rolling cutting profile extends from the nose region of the fixed cutting profile and through the shoulder region of the fixed cutting profile and the exposure is at least partially based on an angular distance between a rotationally aligned pair of a cutting insert of the rolling cutting profile and a fixed cutting element of the fixed cutting profile.

14. The drill bit of claim 13, wherein the blade is a primary blade.

15. The drill bit of claim 13, wherein the blade is a primary blade and the fixed cutting profile is a primary fixed cutting profile and the exposure is a primary exposure, and the drill bit further comprises:

a secondary blade with a secondary fixed cutting profile defining a secondary exposure, wherein the secondary exposure is at least partially based on a secondary angular distance between a rotationally aligned pair of a cutting insert of the rolling cutting profile and a fixed cutting element of the secondary fixed cutting profile.

16. The drill bit of claim 15, wherein the secondary exposure is greater than the primary exposure for radially adjacent fixed cutting elements.

17. The drill bit of claim 15, wherein the secondary exposure is less than the primary exposure for radially adjacent fixed cutting elements.

18. The drill bit of claim 13, wherein the exposure increases proportionately to the angular distance.

19. A drill bit comprising:

a bit body having a bit axis about which the bit body is configured to rotate in a rotational direction;

a roller cone connected to the bit body and having a cone axis around which the roller cone is configured to rotate, the roller cone having a plurality of cutting inserts positioned in a surface of the roller cone, wherein the plurality of cutting inserts form a rolling cutting profile when rotated around the cone axis;

a primary blade having a plurality of primary fixed cutting elements coupled thereto, wherein the plurality of primary fixed cutting elements define a primary fixed cutting profile; and a secondary blade having a plurality of secondary fixed cutting elements coupled thereto, wherein the plurality of secondary fixed cutting elements define a secondary fixed cutting profile, wherein the rolling cutting profile superimposes on the primary fixed cutting profile and the secondary fixed cutting profile in the rotational direction of the bit body and the rolling cutting profile has a primary exposure with respect to the primary fixed cutting profile and a secondary exposure with respect to the secondary fixed cutting profile from a nose region and through a shoulder region, and wherein the primary exposure is based at least partially on:

a primary radial distance between a rotationally aligned primary pair of a cutting insert of the rolling cutting profile and a fixed cutting element of the primary fixed cutting profile, and a primary angular distance between the rotationally aligned primary pair, and wherein the secondary exposure is based at least partially on:

a secondary radial distance between a rotationally aligned secondary pair of a cutting insert of the rolling cutting profile and a fixed cutting element of the secondary fixed cutting profile, and a secondary angular distance between the rotationally aligned secondary pair.

20. The drill bit of claim 1, wherein the exposure increases with an increasing angular distance of a pair of rotationally aligned cutting elements.

* * * * *